US006122590A

United States Patent [19]

Germann et al.

[11] Patent Number: 6,122,590

[45] Date of Patent: Sep. 19, 2000

[54] PROCESS AND DEVICE FOR CONTROL AND MONITORING A TRAFFIC CONTROL SYSTEM

[75] Inventors: Stephan Germann, Brüttisellen; Roland Gutknecht, Elsau; Urs Zünd, Effretikon, all of Switzerland

[73] Assignee: Siemens Schweiz AG, Zurich, Switzerland

[21] Appl. No.: 09/147,642

[22] PCT Filed: Aug. 19, 1997

[86] PCT No.: PCT/CH97/00303

§ 371 Date: Feb. 5, 1999

§ 102(e) Date: Feb. 5, 1999

[87] PCT Pub. No.: WO98/07609

PCT Pub. Date: Feb. 26, 1998

[30] Foreign Application Priority Data

Aug. 23, 1996 [CH] Switzerland ..... 2072/96

[51] Int. Cl.[7] ..... B61L 21/00

[52] U.S. Cl. ..... 701/117; 701/19

[58] Field of Search ..... 701/19, 117; 246/134

[56] References Cited

U.S. PATENT DOCUMENTS

| | | | |
|---|---|---|---|
| 3,937,428 | 2/1976 | Elder | 246/34 R |
| 4,122,523 | 10/1978 | Morse et al. | 701/117 |
| 4,305,556 | 12/1981 | Norton et al. | 246/5 |
| 4,361,300 | 11/1982 | Rush | 246/5 |
| 5,301,906 | 4/1994 | Bodnar, II | 246/3 |
| 5,463,552 | 10/1995 | Wilson, Jr. et al. | 701/117 |

FOREIGN PATENT DOCUMENTS

| | | |
|---|---|---|
| 207488 | 1/1987 | European Pat. Off. . |
| 683082 | 11/1995 | European Pat. Off. . |
| 1030383 | 5/1958 | Germany . |
| 2402875 | 8/1974 | Germany . |
| 3235190 | 3/1984 | Germany . |
| 3232308 | 10/1984 | Germany . |
| 3535785 | 9/1988 | Germany . |
| 4320574 | 12/1994 | Germany . |
| 464281 | 12/1968 | Switzerland . |
| 864030 | 3/1961 | United Kingdom . |

OTHER PUBLICATIONS

European Norm No. EN 50 126, dated Jun. 1, 1996.

European Norm No. EN 50 128, dated Jun. 1, 1995.

*Primary Examiner*—Michael J. Zanelli

*Attorney, Agent, or Firm*—Greenblum & Bernstein, P.L.C.

[57] ABSTRACT

Process and device for controlling and monitoring of a traffic control system which has actuators and monitoring elements and by means of which at least two traffic tracks for railborne vehicles can be controlled by a control process which, upon request for allocation of a route, blocks all the actuators belonging to this route against other requests to create additional routes and control operations and carries out the request. To that effect, each of the changes in the positions or conditions of the actuators to be carried out by the control process, takes place only after successful testing for permissibility by a test process which is independent of the control process and which, in each case, tests whether the actuators and/or monitoring elements to be blocked or to be actuated for the allocation or release of the route already are in use and, thus, have been blocked.

28 Claims, 2 Drawing Sheets

PROCESS AND DEVICE FOR CONTROL AND MONITORING A TRAFFIC CONTROL SYSTEM

BACKGROUND OF THE INVENTION

1. Field of the Invention

The present invention concerns a process and a device for controlling and monitoring of a traffic control system, and more particularly, to a process and device for controlling and monitoring railcars and rails therefor.

2. Discussion of Background Information

Various procedures are used in signal boxes to assign travel routes for railroad traffic. Electronic signal boxes, working in accordance with the principle of secured charts, have a memory in which all selectable routes are recorded. German Patent Application No. DE-AS 10 30 383 (see also DE-PS 35 35 785 C2, column 4, lines 38–47) describes an electronic signal box in which the target loads of all travel route segments to be included in the individual travel routes are stored in a table provided in a memory. The signal orders for the individual travel route segments are derived from the deviations between target and actual loads. This, however, entails a large memory requirement, which increases substantially with the size of the system to be controlled. At larger train stations, more than 50,000 start/finish combinations can be programmed under certain circumstances. In this process, in order to attain the necessary degree of safety, it is necessary to ensure that all data relating to the selectively programmable travel routes have been correctly chosen and stored.

In order to guarantee the greatest possible degree of safety, however, electronic route interlocking stations are primarily in use today, such as are described for example in German Patent No. DE-PS 32 32 308. In the course of the search for travel routes, data words for the computers marked as start and end are entered into the networked multi-computer system linked in accordance with the track diagram; during this process, data words are deposited for a great many switches, a large portion of which will not be needed later. The unnecessary storing and deleting of data words in this electronic signal box leads to "superfluous" processing procedures, which assume unjustifiable proportions, particularly in complex systems.

To reduce costs, in a process known from German Patent No. DE-PS 35 35 785 C2, target-group information is stored in track segments located near tapering switch points, which simplifies the search for travel routes. However, the correct determination and decentralized storage of information in the appropriate memory units entails a corresponding cost.

German Patent Publication No. DE 43 20 574 A1 describes a simplified monitoring of a system controlled by an electronic signal box operating according to the track diagram principle. Herein, individual partial controls are assigned to several track elements at the same time, in order to become operative for them jointly with regard to clear reports and releases. By this means, operational malfunctions are avoided which could otherwise arise as a result of unexpectedly occurring, differing work conditions of the individual track segments. Even this advantageous solution, however, is not suitable for bringing about a greater simplification of the electronic signal box.

The observation of the required safety standards is also of importance. In DE-PS 32 32 308, any failures of the components, which can lead to a change in transferred data, are identified through the transfer and comparison of exclusive-OR data words. This, however, leads to additional cost, without a comprehensive safety test being performed thereby.

It is known from German Patent Publication No. DE-AS 24 02 875 that protection from processing errors can be obtained when all important commands pertaining to safety are processed through two independent ways at practically double cost, where, in operation with only one computer, the double processing of commands is performed with two different programs and an interposed command verification program, through which the processed orders are compared.

Further, European Patent No. EP 0 683 082 A1 describes a device in which the operator of a control system is almost completely freed of monitoring tasks. Here, previously programmed combinations of switch conditions are read out by an indicating device and tested for compatibility with rules of logic stored in a data processing system. These rules of logic are to be prepared during the designing of a signal box and tested for accuracy. In order to guarantee comprehensive safety, error-free rules of logic must be provided at great cost for all switch conditions which might arise.

SUMMARY OF THE INVENTION

The object of the present invention is therefore to present a process for control and monitoring of a traffic control system having actuators and monitoring elements, by means of which at least two tracks for railborne vehicles can be controlled at low cost while meeting stringent safety requirements. Further, a traffic control system operating in accordance with the inventive process, which can be designed at low cost and which guarantees a high safety standard, is to be created.

This object is attained by the present invention.

The process in accordance with the invention permits the simple design of traffic systems, in particular of electronic signal boxes in railroad technology. The use of two independent methods for control and regulation results in lower costs for the design of the system and at the same time in increased operational safety. Upon request for allocation of a travel route, all actuators corresponding to this travel route are blocked, by a control process, against other requests to assign further travel routes and control operations, and are actuated accordingly, where each of the changes in the positions or conditions of the actuators to be performed by the control process takes place only after successful testing for permissibility by a test process which is independent of the control process. Thus, the control process can be realized at a lower cost since the proof of safety is carried out on the basis of a diversity check for permissibility of the changes in the positions or conditions of the actuators by a test process that is independent of the control process.

The allocation and possibly also the release route initiated by the control process according to the secured chart principle are monitored by the test process according to the track diagram principle, in that each case is tested as to whether the actuators and/or monitoring elements to be blocked and actuated are being used for a previously allocated travel route, and are thus already blocked.

The control process preferably works according to the secured chart principle. The allocation and possibly also the release of the travel route initiated by the control process according to the secured chart principle are monitored by the test process, in this case according to the track diagram principle, in that each case is tested as to whether the actuators and/or monitoring elements to be blocked and actuated are being used for a previously allocated travel route, and are thus already blocked.

The control process according to the secured chart principle can be designed easily by constructing a table in which are entered the positions and conditions of the actuators provided for the individual travel routes. The travel routes thus can be switched easily, which eliminates a costly travel route search according to the track diagram principle with the problems described above. For verification of the positions and conditions designated by the control process for the actuators is performed advantageously in accordance with the track diagram principle, through which all positions and conditions of the actuators blocked for other travel routes are taken into consideration. Thus the positions and conditions to be switched are not tested on the basis of numerous rules of logic prepared in advance, but rather on the basis of the actually existing condition of the entire system. An increased operational safety results from this comprehensive test. Furthermore, the test in accordance with the track diagram principle takes place at low cost, since the correct and complete preparation of test rules for programming the travel routes, which is costly, is eliminated.

The use of modern control technology, in particular, also makes it possible to realize the control process according to the track diagram principle at reduced cost. To guarantee the required safety the test process, which is independent of the control process, is in this case performed according to the secured chart principle. The measures in accordance with the invention thus make it possible to realize a system control based on two independent processes, tailored to a planned rail topology and a required level of safety, with the least possible cost. The control process is preferably realized in smaller systems according to the secured chart principle and in larger systems according to the track diagram principle. Relatively high costs for the realization of the control process are eliminated, however, because the required proof of safety can be met more easily through the use of the test process independent of the control process.

BRIEF DESCRIPTION OF THE DRAWINGS

The invention is explained in greater detail with the aid of the drawings in the following examples. Herein.

DETAILED DESCRIPTION OF THE PRESENT INVENTION

Figure 1:
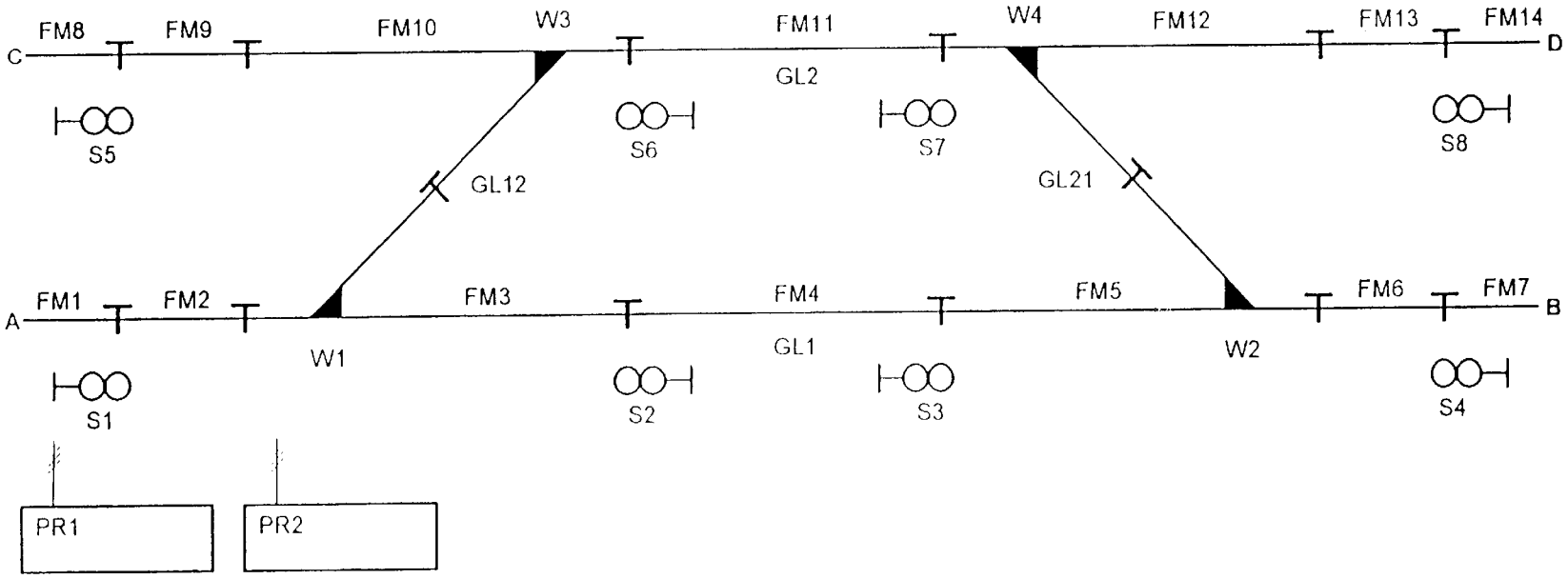
FIG. 1 shows a railroad system with two parallel tracks, which can be connected to each other via two connecting tracks and two switches each.
Figure 2:
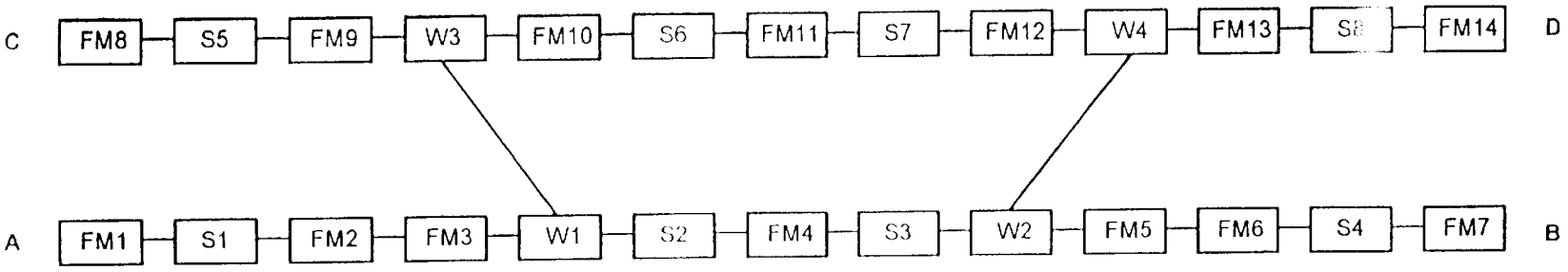
FIG. 2 shows the track diagram of the system in accordance with FIG. 1.

FIG. 1 shows a railroad system with two parallel tracks GL1, GL2 going from A to B or from C to D which can be connected to one another by two connecting tracks GL12, GL21 and two switches W1, W3 or W4, W2 which are attached to each of these connecting tracks GL12, GL21. The tracks GL1, GL2 are divided into different segments, which are monitored by the clear-signal indicators FM1, . . . , FM14. The track segments around the switches W1, . . . W4 up to the middle of the corresponding connecting tracks GL12, GL21 are monitored by the clear-signal indicators FM3, FM5, FM10 and FM12. Provided following the segments associated with the clear-signal indicators FM1, FM7, FM8, and FM14 are signals S1, S4, S5, or S8. Assigned to the segments associated with the clear-signal indicators FM4 and FM11 are the signals S2 and S3 or S6 and S7.

Figure 3:
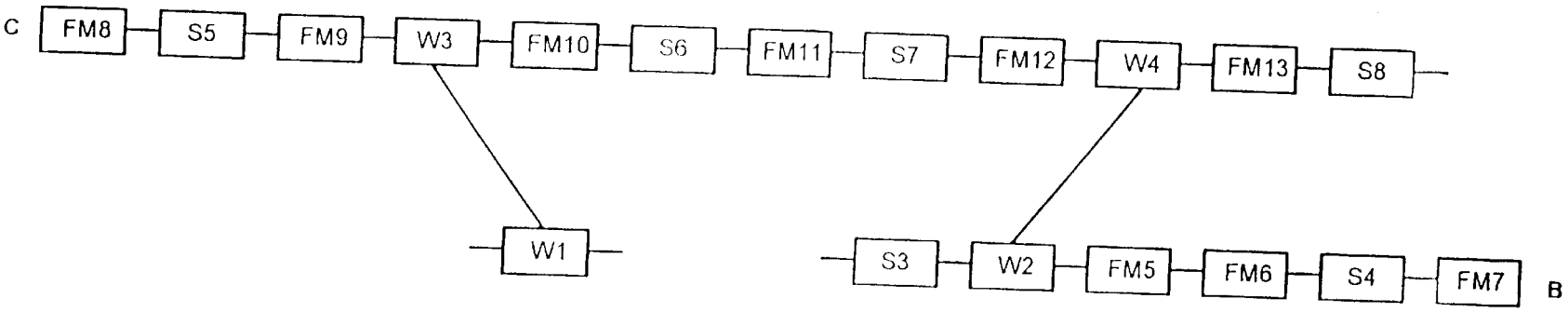
FIG. 3 shows the track diagram of a prepared travel route from C to B.
Figure 4:
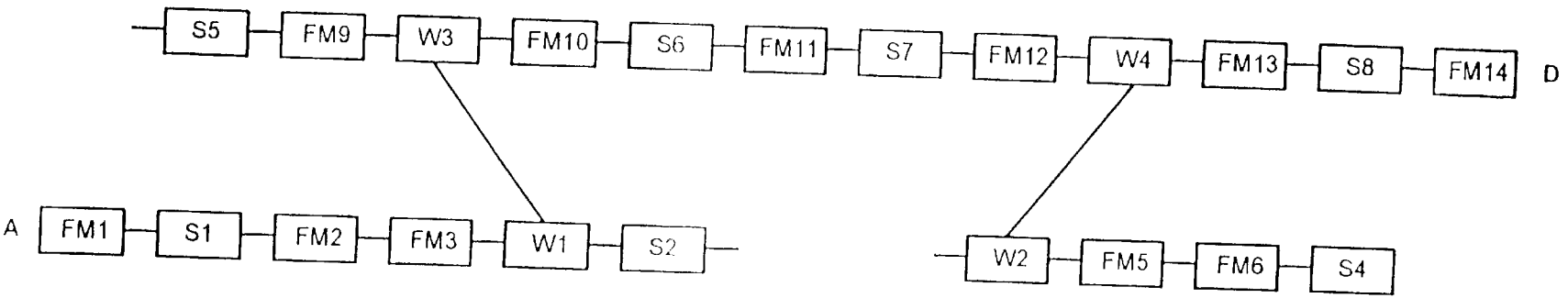
FIG. 4 shows the track diagram of a prepared travel route from A to D.

The following travel routes can be set between points A, B, C and D, departing from point A or point C (excluding shunt routes):

Travel route 1 From A to B via track GL1,

Travel route 2 From A to B via track GL1, connecting track GL12, track GL2, connecting track GL21, and track GL1, Travel route 3 From A to D via track GL1, connecting track GL12 and track GL2 (see FIG. 4), Travel route 4 From C to D via track GL2, and Travel route 5 From C to B via track GL2, connecting track GL21 and track GL1 (see FIG. 3).

At the request for allocation of a travel route (for example travel route 1), a control process blocks all actuators associated with this route against other requests for the allocation of additional travel routes (for example, one of the travel routes 2,3,4 or 5) and control operations, and actuates them accordingly. Each of the changes in the positions or conditions of the actuators to be performed by the control process takes place only after successful testing for permissibility by a test process which is independent of the control process. Monitoring of the allocation and possibly also the release of the travel route initiated by the control process according to the secured chart principle is done by the test process according to the track diagram principle, in that each case is tested as to whether the actuators and/or monitoring elements to be blocked and actuated are being used for a previously allocated travel route, and are thus already blocked.

For travel routes 1, . . . , 5 the track segments S1, . . . S8, W1, . . . W4, FM1, . . . FM14 are in the conditions listed in Table 1 below. This Table 1 corresponds to the table described in DE-AS 10 30 383, in which the target loads of all travel route segments to be included in the various travel routes are stored. Travel routes 1, . . . 5 can thus be set by means of a control process.

TABLE 1

| (Element) | Travel route 1 | Travel route 2 | Travel route 3 | Travel route 4 | Travel route 5 |
|---|---|---|---|---|---|
| S1 | Go | Go | Go | any | any |
| S2 | Stop | Stop | Stop | any | any |
| S3 | Go | Stop | any | any | Stop |
| S4 | Stop | Stop | any | any | Stop |
| S5 | any | Stop | Stop | Go | Go |
| S6 | any | Stop | Stop | Stop | Stop |
| S7 | any | Go | Go | *Go | Go |
| S8 | any | Stop | Stop | Stop | Stop |
| W1 | straight | diverted | diverted | straight | straight |
| W2 | straight | diverted | straight | straight | diverted |
| W3 | straight | diverted | diverted | straight | straight |
| W4 | straight | diverted | straight | straight | diverted |
| FM1 | clear | clear | clear | any | any |
| FM2 | clear | clear | clear | any | any |
| FM3 | clear | clear | clear | any | any |
| FM4 | clear | any | any | any | any |
| FM5 | clear | clear | any | any | clear |
| FM6 | clear | clear | any | any | clear |
| FM7 | clear | clear | any | any | clear |
| FM8 | any | any | any | clear | clear |
| FM9 | any | any | any | clear | clear |
| FM10 | any | clear | clear | clear | clear |
| FM11 | any | clear | clear | clear | clear |
| FM12 | any | clear | clear | clear | clear |
| FM13 | any | any | clear | clear | any |
| FM14 | any | any | clear | clear | any |

To ensure a required safety standard for signal boxes working according to the secured chart principle, such as are known from DE-AS 10 30 383, very high safety standards must be chosen in particular in the preparation of the software. The so-called Software Integrity Level is determined by a process named in European Norm EN 50 126. In this context, the various risk factors (dangers to human life, dangers to human health, ecological dangers, dangers to goods) must be taken into consideration. The following Software Integrity Levels are defined as follows in said standard:

TABLE 2

| Software Integrity Level | Software Integrity |
|---|---|
| 4 | very high |
| 3 | high |
| 2 | medium |
| 1 | low |
| 0 | non safety related |

Known signal boxes operating in accordance with the secured chart principle must therefore be designed and executed at great expense in consideration of the highest Software Integrity Level in accordance with European Norm EN 50128. In train stations with a relatively large number of travel routes, the result is thus an enormous expense for these known signal boxes.

Therefore, in accordance with the invention it is ensured that the risk factors to be considered in the design of a signal box operating according to the combined secured chart and track diagram principles can be lowered a safety level, so that the software necessary for the control process, while maintaining the required safety standards, can be prepared at a low Software Integrity Level for signal boxes and thus at low expense.

Each change in the positions or conditions of the actuators to be performed by the control process according to the secured chart principle thus takes place only after successful testing for permissibility by a test process which is independent of the control process. It is known from Norm EN 50128, section B, 17 or from DE-AS 24 02 875, that protection from processing errors can be achieved when all commands important for safety are processed through two independent pathways, where, in operation with only one computer, the double processing of commands is performed with two different programs and an interposed command verification program, through which the processed orders are compared. Because the independent test process works according to the track diagram principle, a diversity check of the permissibility of the changes in the positions or conditions of the actuators is present. Instead of processing a control command at great cost through two independent pathways, a command is processed according to the secured chart principle and an independent test is performed according to the track diagram principle. The test according to the track diagram principle guarantees a high degree of safety, as is known. Since the travel route search and process control according to the track diagram system are eliminated, the result is a low cost for the design and implementation of the test process. Monitoring of the allocation and possibly also the release of the travel route initiated by the control process according to the secured chart principle is done by the test process according to the track diagram principle, in that each case is tested as to whether the actuators and/or monitoring elements to be blocked and actuated are being used for a previously allocated travel route, and are thus already blocked.

The control process and the test process independent thereof can be controlled by software that is stored in computers operating in parallel or separately, or in only one single computer. It will be assumed in the following for the sake of simplicity that, as shown in FIG. 1, the control process is controlled by a control process computer PR1 and the test process by a test process computer PR2. The control process computer PR1 has a memory which among other things serves to store the data of the secured chart. The test process computer PR2 has a memory which among other things serves to store the assigned travel routes and preferably also to store the track diagram of the monitored route network. The control of the actuators and the monitoring of the conditions of the track segments is performed as in the signal boxes known from prior art.

When travel route 1 is set by the control process, all corresponding actuators are blocked against other requests for travel routes and control operations. If travel route 5 has already been assigned, the conditions of the track segments associated with travel route 5 are stored in the test process computer PR2. The control process is able to assign the travel routes automatically. To guarantee the necessary safety, all control commands generated by the control process according to the secured chart principle are verified, element by element, in the test process according to the track diagram principle on the basis of the actual position of the actuators and the existing information from the monitoring elements and are tested, taking into consideration the travel routes already assigned, in particular regarding incompatible travel routes and needed flank protection, and cleared if no conflicts are discovered. If, however, an error occurs in the control process and, for instance, Signal S3 should be set on Go, even though Signal S3 is set on Stop for the previously programmed travel route (see Table 3), this will be discovered immediately by the test process on the basis of the conditions contained in the test computer for the track segments associated with travel route 5, whereupon the control process is halted and an error is reported.

TABLE 3

| | Travel route 1 | Travel route 5 |
|---|---|---|
| S3 (element) | Go | Stop |

Furthermore, it can also be determined by means of the test process whether the flank protection for the assigned travel route is secured. In travel route 5 shown in FIG. 3, flank protection is secured by Switch W1, and Signals S3 and S8. For this purpose, Switch W1 is blocked in the condition "straight" and Signals S3 and S8 in the condition "Stop." In travel route 3, shown in FIG. 4, flank protection is secured by Signals S2, S5 and S4. Signals S3 and S8 are blocked in the condition "Stop." Before a travel route can be cleared, the test process can once again determine whether conflicts with other travel routes or regulations exist. After a travel route is cleared (for instance, travel route 1 is cleared after release of travel route 5), its data are stored in the memory of test process computer PR2 and used to double-check the actions of the control process.

After a command to assign a travel route is successfully executed, the control process could, for example, determine whether the elements listed in the corresponding rows of the secured chart (Table 1) are used for other routes, reserved, or cleared for switching (the control process thus does not see a route, but rather the arbitrarily arranged segments of a row of the secured chart). As soon as all the units of a row of the secured chart are cleared and reserved for assigning a new route, a double-checking according to the track diagram principle takes place. The test process, working according to the track diagram principle, makes use here of the data on the track topology at least for every assignable route. The double-checking can be performed at greater or lesser expense. For instance, only the alterations planned by the control process will be tested as to whether they lead to a correct assignment of the route. If, for example, an incorrect setting is planned for a switch, this will not be recognized by the control process, which has no knowledge of the topology of the track network and the routes. The problem will be recognized easily by the test process, functioning independently of the control process and according to the track diagram principle, because the track is interrupted between its end points due to the faulty setting of the switch. Likewise, an incomplete setting can be recognized, where applicable . On a further level, the test process can even test further basic requirements, for example flank protection, maximum permissible speed, etc.

The test preferably takes place, as described in the above paragraph, after all units listed in a row of the secured chart have been reserved. After successful testing, the route is assigned as a whole. It is furthermore possible to perform the test before changing each individual unit.

In a preferred embodiment of the invention, the test process operating according to the track diagram principle is linked to a list of parameters, which permits the double-checking of customer-specific settings that are to be performed by the control process and are independent of the topology of the routes to be assigned (for example, a decentrally-positioned signal lamp is to be incorporated into a route serving express train traffic). The signal lamp thus becomes an element in the corresponding row of the secured chart and is monitored by the test process with the aid of the list of parameters.

As described at the outset, the control process is realized more easily by the secured chart principle in small systems, and by the track diagram principle in larger systems (accordingly, the test process is realized by means of the track diagram or, respectively, the secured chart principle). In between is a zone in which the control process can be realized according to the secured chart principle or the track diagram principle with little difference in regard to the cost. It should be noted, however, that systems have the tendency to grow and that products are supposed to exhibit a gradually increasing performance capacity with each generation. The choice of principle by which to realize the control process is therefore to be decided from case to case and under consideration of the existing basic requirements and the prepared development prognosis.

Thus, the performance capacity of both processes should preferably be tailored to each other with consideration for the totality of safety requirements to be met. For example, the performance capacity of the control process can be reduced in regard to the meeting of the safety requirements, if a correspondingly greater performance capacity is selected for the test process.

Thus, the system structure of both processes should preferably be modular so that they can be tailored appropriately to the totality of safety requirements to be met at little cost.

What is claimed is:

1. A process for controlling and monitoring of a traffic control system, the system having actuators, monitoring units and at least two tracks for rail vehicles, comprising:

blocking, by a control process, all of a plurality of actuators corresponding to a requested travel route against further requests to allocate further travel routes and further control operations, upon request for allocation of a requested travel route;

testing, by a test process, whether one of the actuators and monitoring units to be blocked and actuated for the allocation and release of a requested travel route, are being used for a previously allocated requested travel route, and are thus already blocked, the test process being independent of the control process; and setting each actuator in correspondence with the requested travel route.

2. The process for controlling and monitoring of a traffic control system according to claim 1, wherein the system further comprises switches that are controlled by the control process, the switches automatically seeking flank protection.

3. The process for controlling and monitoring of a traffic control system according to claim 1, wherein the control process operates according to one of a track diagram principle and a secured chart principle.

4. The process for controlling and monitoring of a traffic control system according to claim 1, wherein the test process operates according to one of a track diagram principle and a secured chart principle.

5. The process for controlling and monitoring of a traffic control system according to claim 4, further comprising:

verifying, element by element, in the test process according to the track diagram principle, all control commands generated by the control process according to the secured chart principle, said verification being performed on the basis of the actual positions of the actuators and the existing information from the monitoring elements;

testing possible conflicts with at least one of already assigned travel routes and needed flank protection;

evaluating predefined criteria in the testing process, the criteria comprising the travel route to be assigned; and clearing the control commands if no conflicts are discovered.

6. The process for controlling and monitoring of a traffic control system according to claim 4, further comprising:

verifying all control commands generated by the control process according to the secured chart principle, in the test process according to the track diagram principle, element by element, on the basis of the actual positions of the actuators and the existing information from the monitoring elements;

testing possible conflicts with at least one of already assigned travel routes and needed flank protection;

evaluating at least one of travel routes already assigned, incompatible travel routes, and needed flank protection; and clearing the control commands if no conflicts with the evaluated travel routes and needed flank protection are discovered.

7. The process for controlling and monitoring of a traffic control system according to claim 6, further comprising:

storing the data for the travel route cleared by the test process in a memory controlled by the test process, the memory containing data of previously assigned travel routes; and using the data for the travel route cleared by the test process to check further travel routes to be assigned.

8. The process for controlling and monitoring of a traffic control system according to claim 7, comprising deleting a travel route recorded in the memory, element-by-element, using standard release as the elements become cleared by the test process, after a vehicle for which the travel route was assigned has passed the cleared elements.

9. The process for controlling and monitoring of a traffic control system according to claim 1, wherein the test by the test process takes places as a whole after one of:

a) blocking all control units, and b) blocking each individual control unit before changing each individual control unit.

10. The process for controlling and monitoring of a traffic control system according to claim 1, wherein the setting of each actuator in correspondence with the requested travel route occurs only after the test process successfully tests for the permissibility of each setting.

11. The process for controlling and monitoring of a traffic control system according to claim 10, wherein the test process operates according to the track diagram principle, the process for controlling and monitoring of a traffic control system further comprising a list of parameters, the list of parameters serving to check settings which are not directly connected with the track to be assigned.

12. The process for controlling and monitoring of a traffic control system according to claim 1 further comprising performing said testing in accordance with safety regulations of railroad technology.

13. The process for controlling and monitoring of a traffic control system according to claim 1, further comprising:

monitoring, by the control process, the establishment of the requested travel route; and releasing, by the control process, the actuators for release of the requested travel route.

14. A device for controlling and monitoring of a traffic control system, the system having actuators, monitoring units and at least two tracks for rail vehicles, the device comprising:

a control process system configured to operate a control process, the control process adapted to block all of a plurality of actuators corresponding to a requested travel route against further requests to allocate further travel routes and further control operations, upon request for allocation of a requested travel route;

a test process system configured to operate a test process, the test process system being independent of said control process system; and a controller adapted to control said control process system and said test process system.

15. The device for controlling and monitoring of a traffic control system according to claim 14, wherein said controller is stored in a plurality of computers operating in parallel.

16. The device for controlling and monitoring of a traffic control system according to claim 14, wherein said controller is stored in a plurality of computers operating independently.

17. The device for controlling and monitoring of a traffic control system according to claim 14, wherein said controller is stored in a single computer.

18. The device for controlling and monitoring of a traffic control system according to claim 14, wherein the control process system is adapted to operate according to one of a track diagram principle and a secured chart principle.

19. The process for controlling and monitoring of a traffic control system according to claim 14, wherein the test process system is adapted to operate according to one of a track diagram principle and a secured chart principle.

20. The device for controlling and monitoring of a traffic control system according to claim 14, further comprising:

a control process computer adapted to control said control process system; and a test process computer adapted to control the test process system.

21. The device for controlling and monitoring of a traffic control system according to claim 20, further comprising:

a memory located within said control process computer adapted to store a secured chart; and a memory located within said test process computer adapted to store assigned travel routes.

22. The device for controlling and monitoring of a traffic control system according to claim 21, wherein said memory located within said test process computer is further adapted to store a track diagram of a monitored route network.

23. The device for controlling and monitoring of a traffic control system according to claim 21, wherein said memory located within said control process computer is further adapted to store a track diagram of a monitored route network.

24. The device for controlling and monitoring of a traffic control system according to claim 20, further comprising:

a memory located within said control process computer adapted to store data of a secured chart; and a memory located within said test process computer adapted to store assigned travel routes.

25. The device for controlling and monitoring of a traffic control system according to claim 24, wherein said memory located within said test process computer is further adapted to store a track diagram of a monitored route network.

26. The device for controlling and monitoring of a traffic control system according to claim 20, further comprising:

a memory located within said test process computer adapted to store data of a secured chart; and a memory located within said control process computer adapted to store assigned travel routes.

27. The device for controlling and monitoring of a traffic control system according to claim 26, wherein said memory located within said control process computer is further adapted to store a track diagram of a monitored route network.

28. The device for controlling and monitoring of a traffic control system according to claim 14, the test process system being adapted to test the permissibility of each setting of each actuator in correspondence with the requested travel route only after the test process successfully tests for the permissibility of each setting.

* * * * *